US010723425B2

(12) United States Patent
Pinnekamp et al.

(10) Patent No.: US 10,723,425 B2
(45) Date of Patent: Jul. 28, 2020

(54) SUBMARINE DRIVE SYSTEM

(71) Applicant: RENK AKTIENGESELLSCHAFT, Augsburg (DE)

(72) Inventors: Burkhard Pinnekamp, Augsburg (DE); Dietrich Wittekind, Raisdorf (DE); Thomas Schmidbauer, München (DE); Bernhard Vollmer, Niederaltreich (DE); Tobias Kleinheinz, Horgau (DE); Franz Hoppe, Stadtbergen (DE)

(73) Assignee: RENK Aktiengesellschaft, Augsburg (DE)

( * ) Notice: Subject to any disclaimer, the term of this patent is extended or adjusted under 35 U.S.C. 154(b) by 0 days.

(21) Appl. No.: 16/322,735

(22) PCT Filed: Apr. 11, 2017

(86) PCT No.: PCT/EP2017/058638
§ 371 (c)(1),
(2) Date: Feb. 1, 2019

(87) PCT Pub. No.: WO2018/024378
PCT Pub. Date: Feb. 8, 2018

(65) Prior Publication Data

US 2019/0202538 A1 Jul. 4, 2019

(30) Foreign Application Priority Data

Aug. 4, 2016 (DE) ..... 10 2016 214 494

(51) Int. Cl.
*B63G 8/08* (2006.01)
*B63H 21/17* (2006.01)
*B63H 23/24* (2006.01)

(52) U.S. Cl.
CPC ..... *B63G 8/08* (2013.01); *B63H 21/17* (2013.01); *B63H 23/24* (2013.01); *B63H 2023/245* (2013.01)

(58) Field of Classification Search
CPC ..... B63H 21/00; B63H 21/17; B63H 21/20; B63H 21/21; B63H 23/00; B63H 23/24;
(Continued)

(56) References Cited

U.S. PATENT DOCUMENTS 1,332,631 A * 3/1920 Morse ..... B63G 8/08 440/3
2,106,958 A 2/1938 Pettit, Jr.
(Continued)

FOREIGN PATENT DOCUMENTS

CN 103009167 4/2013
CN 203293892 U 11/2013
(Continued)

OTHER PUBLICATIONS

Office Action dated Oct. 4, 2019 issued in Canadian Patent Application No. 3,024,563.
(Continued)

*Primary Examiner* — Lars A Olson
(74) *Attorney, Agent, or Firm* — Cozen O'Connor

(57) ABSTRACT

A submarine drive system of a submarine, having a drive shaft, a drive propeller coupled to the drive shaft (2), and an electric motor for driving the drive shaft. A main drive having at least one first electric motor is designed for full-load operation and is or can be coupled to the drive shaft on the drive side, and an additional drive having at least one second electric motor is designed for part-load operation for creep operation or submerged operation of the submarine and likewise is or can be coupled to the drive shaft on the drive side.

15 Claims, 3 Drawing Sheets

(58) Field of Classification Search
CPC ..... B63H 20/00; B63H 20/14; B63G 8/00; B63G 8/08
USPC ..... 114/337; 440/3, 6
See application file for complete search history.

(56) References Cited

U.S. PATENT DOCUMENTS

| | | | | |
|---|---|---|---|---|
| 5,713,299 | A | 2/1998 | Lopez | |
| 7,803,024 | B2 * | 9/2010 | Su | B63H 23/24 440/3 |
| 8,393,926 | B2 * | 3/2013 | Bratel | B63H 21/20 440/75 |

FOREIGN PATENT DOCUMENTS

| | | |
|---|---|---|
| CN | 203458397 U | 3/2014 |
| DE | 679 153 | 7/1939 |
| DE | 1 112 423 | 8/1961 |
| DE | 1 120 309 | 12/1961 |
| DE | 199 58 783 | 5/2001 |
| DE | 100 63 338 | 6/2002 |
| DE | 10 2004 053 108 | 5/2006 |
| DE | 10 2012 208 065 | 11/2013 |
| EP | 2 664 536 | 11/2013 |
| GB | 168 834 | 9/1921 |
| JP | H 09-502680 | 3/1997 |
| JP | H0986496 | 3/1997 |
| JP | 2012-062950 | 3/2012 |
| WO | WO 2015/075146 | 5/2015 |

OTHER PUBLICATIONS

Office Action dated Mar. 20, 2020 issued in Chinese Patent Application No. 201780049021.4.
Office Action dated Apr. 20, 2020 issued in Korean Patent Application No. 10-2019-7000202.

* cited by examiner

SUBMARINE DRIVE SYSTEM

CROSS-REFERENCE TO RELATED APPLICATIONS

This is a U.S. national stage of application No. PCT/EP2017/058638, filed on Apr. 11, 2017. Priority is claimed on German Application No. DE102016214494.4, filed Aug. 4, 2016, the content of which is incorporated herein by reference.

BACKGROUND OF THE INVENTION

1. Field of the Invention

The invention relates to a submarine drive system.

2. Description of the Prior Art

Submarine drive systems comprising a drive shaft, a drive propeller coupled to the drive shaft, and an electric machine for driving the drive shaft are already known. Here, the electric machine of a submarine drive system is directly coupled to the drive shaft according to practice. The electric machine is utilised both for full-load operation and also for a part-load operation. Efficiency disadvantages result in particular during the part-load operation. Furthermore, relative large electric machines have to be employed.

From DE 10 2012 208 065 A1 a drive system of a ship is known, in which an electric machine is directly or indirectly coupled to a drive shaft via a transmission. By connecting a transmission between the electric machine and the drive shaft, smaller, lighter and more cost-effective electric machines can be employed, in particular since the electric machine can then be operated with a rotational speed of the drive shaft or of the drive propeller driven by the drive shaft that is higher than the required rotational speed.

SUMMARY OF THE INVENTION

Starting out from this, one aspect of the present invention is based on creating a new type of submarine drive system.

According to one aspect of the invention, a main drive comprising at least one first electric machine is designed for a full-load operation and is coupled or can be coupled to the drive shaft on the drive side, wherein an additional drive comprising at least one second electric machine is designed for a part-load operation for stealth operation and/or submerged operation of the submarine and is or can likewise be coupled to the drive shaft on the drive side. Accordingly, the submarine drive system comprises at least two electric machines. The or each first electric machine is designed for the full-load operation and is employed during full-load operation and below. The or each second electric machine is designed for the part-load operation and is employed during the part-load operation. By way of this, efficiency disadvantages during the part-load operation can be avoided through the or each second electric machine that is specifically adapted to the part-load operation.

Advantageously, the or each first electric machine designed for the full-load operation is or can be indirectly or directly coupled via a first transmission to the drive shaft on the drive side, wherein the or each second electric machine designed for the part-load operation is or can be coupled indirectly to the drive shaft on the drive side via a first transmission, wherein the or each second electric machine designed for the part-load operation is coupled or can be coupled directly or via the first transmission indirectly or via a second transmission indirectly to the drive shaft on the drive side. Because of this it is possible to embody in particular the first electric machine designed for the full-load operation smaller, lighter, and more cost-effectively.

According to a first version of the invention, the or each second electric machine is mounted or supported on the first transmission and together with the or each first electric machine and the first transmission jointly supported on a foundation of the submarine. With the first version an elastic compensation coupling is preferentially connected between an output of the first transmission and a thrust bearing of the drive shaft. This first version is particularly suited for submarine drive systems.

According to a second version of the invention, the or each second electric machine is supported on a foundation of the submarine directly or via the second transmission indirectly in each case dependent on the or each first electric machine and the first transmission. The second version of the invention is also particularly suited for submarine drive systems, wherein the second version of the invention has advantages in terms of the required installation space.

With the second version, an elastic compensation coupling is connected between the second electric machine or an output of the second transmission and a thrust bearing or axial bearing of the drive shaft. With the second version, the elastic compensation coupling can be smaller than with the first version. Furthermore, the thrust bearing of the drive shaft with the second version is preferentially integrated in the first transmission. The integration of the thrust bearing in the first transmission with the second version of the invention results in further installation space advantages.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

DETAILED DESCRIPTION OF THE PRESENTLY PREFERRED EMBODIMENTS

Figure 1:
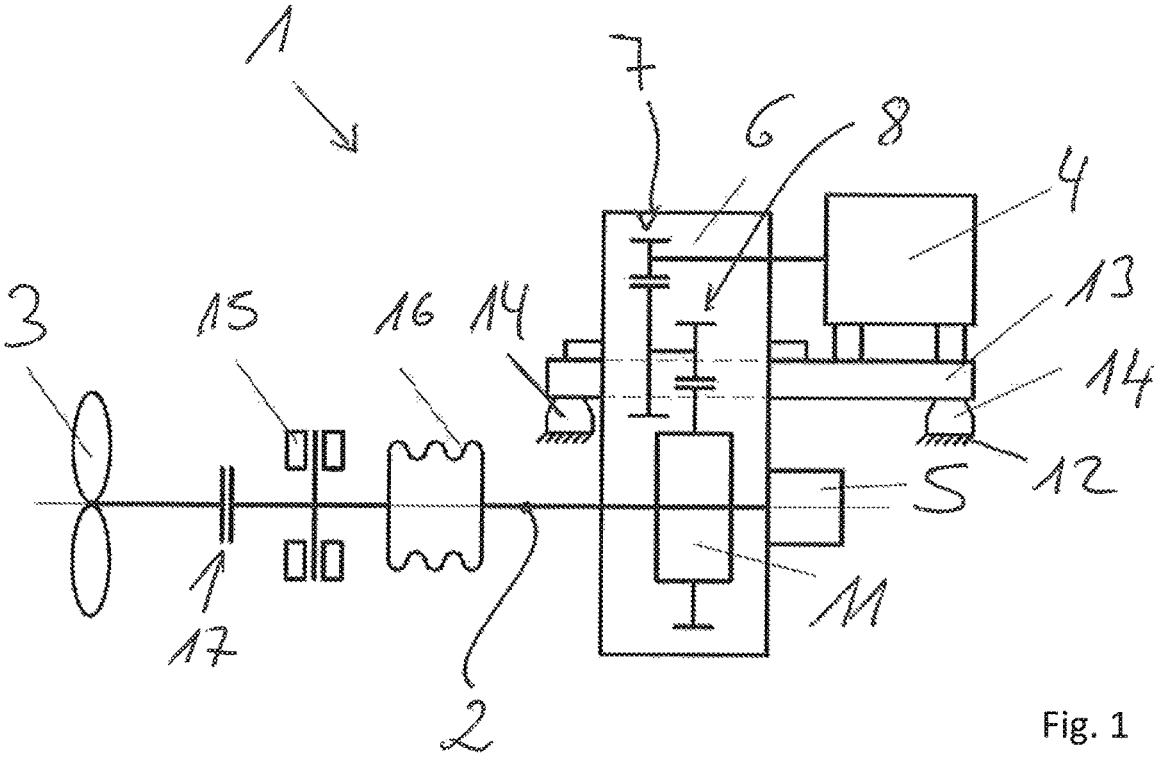
FIG. 1: is a block diagram of a submarine drive system according to one aspect of the invention.

FIGS. 1 to 5 show different exemplary embodiments of submarine drive systems 1 according to aspects of the invention. All submarine drive systems 1 of FIGS. 1 to 5 have in common that each comprises a drive shaft 2, a drive propeller 3 coupled to the drive shaft 2, and multiple electric machines 4, 5. At least one first electric machine 4 of a main drive for driving the drive shaft 2 and thus the drive propeller 3 is designed for a full-load operation of the submarine drive system and is coupled or can be coupled to the drive shaft 2 on the drive side. At least one second electric machine 5 of an additional drive is designed for a part-load operation of the submarine drive system 1 and is or can likewise be coupled to the drive shaft 2 on the drive side, wherein during the part-load operation of the submarine drive system 1 the submarine is typically operated in stealth mode and/or submerged mode.

It is thus an idea of the submarine drive system 1 according to the invention, to provide multiple electric machines 4, 5 for driving the drive shaft 2, namely a first electric machine 4 designed for the full-load operation and a second electric machine 5 designed for the part-load operation for a stealth operation and/or submerged operation, which are operated dependent on the operating state, i.e. dependent on whether a full-load operation or part-load operation is required, and for this purpose are coupled to the drive shaft 2 or decoupled from the same. During the full-load operation the first electric machine 4 is typically coupled to the drive shaft 2 and the second electric machine 5 decoupled from the same. During the part-load operation, the second electric machine 5 is typically coupled to the drive shaft 2 and the second electric machine 4 decoupled from the same.

According to an advantageous further development of the invention it is provided that the first electric machine 4 of the submarine drive system 1 designed for the full-load operation is indirectly coupled via a first transmission 6 to the drive shaft 2 on the drive side. Here, the first transmission 6 comprises gearwheel planes 7, 8 of intermeshing gearwheels, which provide at least one transmission stage.

Accordingly, the first transmission 6 is a step-up transmission, the step-up stages are designed so that the first electric machine 4 can be operated with significantly higher rotational speed than is required for driving the drive propeller 3 and thus the drive shaft 2. Because of this, smaller, lighter and more cost-effective electric machines can be employed for the full-load operation than is possible with submarine drive systems known from practice.

Furthermore, the first transmission 6 comprises a clutch 11, which is preferentially embodied as a synchronised clutch.

The second electric machine 5 designed for the part-load operation and is mounted or supported on the first transmission 6 in the exemplary embodiment of FIG. 1 and directly coupled, i.e. without further transmission stage, to the drive shaft 2 on the drive side.

Figure 2:
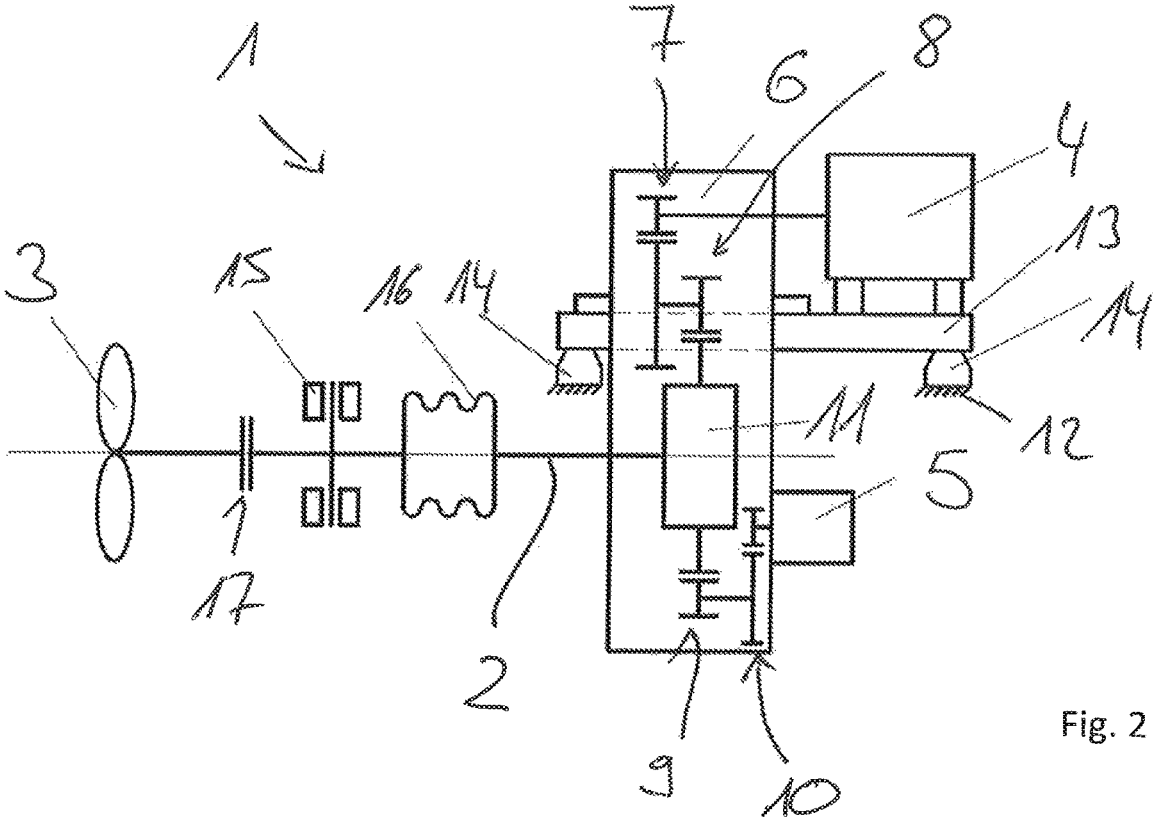
FIG. 2: is a block diagram of a submarine drive system according to one aspect of the invention.

FIG. 2 shows an exemplary embodiment in which the second electric machine 5 is designed for the full-load operation and is mounted or supported on the first transmission 6 but indirectly coupled via the first transmission 6 to the drive shaft 2 on the drive side, namely in FIG. 2 via a separate transmission stage of the first transmission 6 formed by further gearwheel planes 9, 10.

In the exemplary embodiment of FIG. 3, the second electric machine 5 is designed for the part-load operation and is mounted on the first transmission 6 in conformity with the exemplary embodiments of FIGS. 1 and 2 and in the exemplary embodiment of FIG. 3, again in conformity with the exemplary embodiment of FIG. 2, is again indirectly connected via the first transmission 6 to the drive shaft 2 on the drive side. However, in the exemplary embodiment of FIG. 3, the second electric machine 5 unlike in the exemplary embodiment of FIG. 2, is not connected to the drive shaft 2 via a separate transmission stage but rather via the transmission stage formed by the gearwheel planes 7 and 8 of the first electric machine 4. While the embodiment of FIG. 3 is particularly compact and simple, the exemplary embodiment of FIG. 2 has efficiency advantages.

Figure 3:
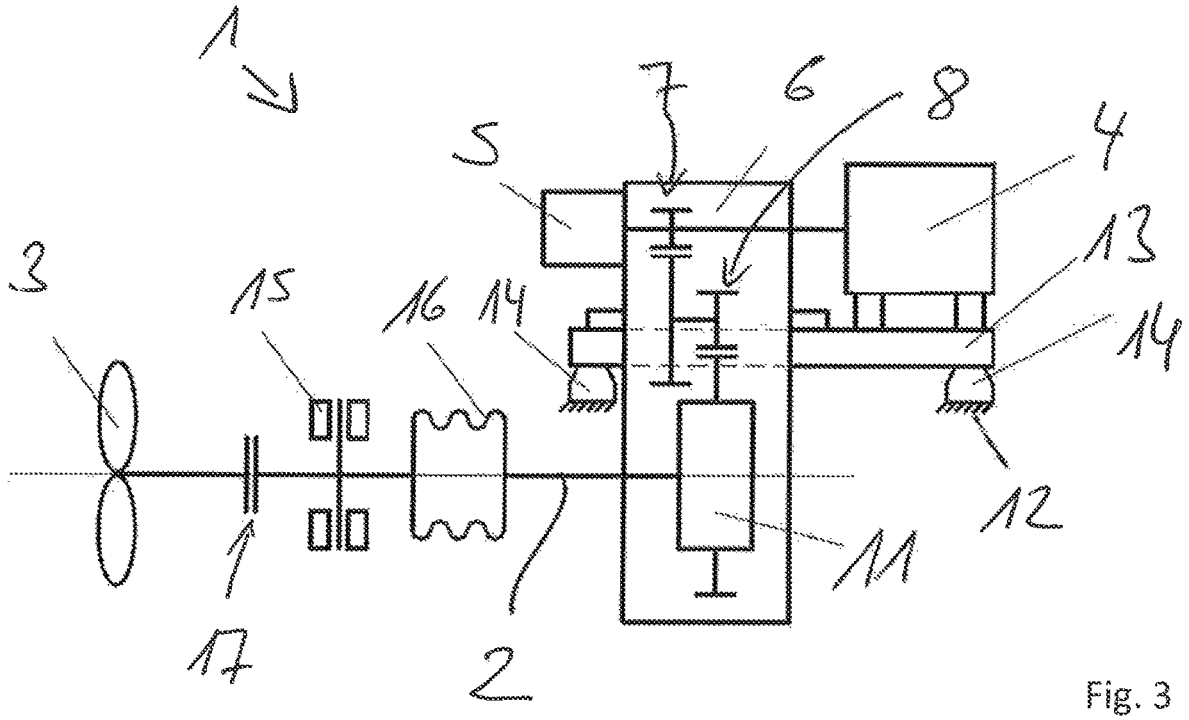
FIG. 3: is a block diagram of a submarine drive system according to one aspect of the invention.

As already explained, all exemplary embodiments of FIGS. 1 to 3 have in common that the respective submarine drive system 1 comprises multiple electric machines, namely the first electric machine 4 for the full-load operation and the second electric machine 5 for the part-load operation, wherein the second electric machine 5 for the part-load operation is mounted or supported on the first transmission 6, which serves as step-up transmission at least for the first electric machine 4, which is designed for the full-load operation. Optionally, as shown in FIGS. 2 and 3, the first transmission 6 can also serve as step-up transmission for the second electric machine 5 designed for the part-load operation.

In the exemplary embodiments of FIGS. 1, 2, and 3, in which the second electric machine 5 designed for the part-load operation is mounted or supported on the first transmission 6, the electric machine 5 together with the first electric machine 4 and together with the first transmission 6 are jointly supported on a foundation 12 of the submarine 1, for the purpose of which in the exemplary embodiments of FIGS. 1 to 3 the first electric machine 4 and the first transmission are mounted on a common frame 13, so that the second electric machine 5 is also mounted via the first transmission 6 on this common frame 13. By way of this common frame 13, the two electric machines 4, 5 and the first transmission 6 are jointly supported on the foundation 12 of the submarine.

Between the common frame 13 and the foundation 12, elastic sound-damping elements 14 are connected. These are significant in particular when during the part-load operation of the submarine drive system 1, the submarine is operated in stealth operation or submerged operation.

Furthermore, the submarine drive systems 1 of FIGS. 1, 2, and 3 comprise an axial bearing or thrust bearing 15 assigned to the drive shaft 2, an elastic compensation coupling 16 assigned to the drive shaft 2 and a clutch 17 likewise assigned to the drive shaft. The axial bearing or thrust bearing 15 serves for absorbed axial forces acting on the drive shaft 2. Shearing forces are directed from the axial bearing or thrust bearing 15 into the hull or into the foundation of the submarine. Moments are transmitted to the drive propeller 3 via the elastic compensation coupling 16. By way of the clutch 17, the drive propeller 3 can be decoupled from the drive shaft 2.

Figure 4:
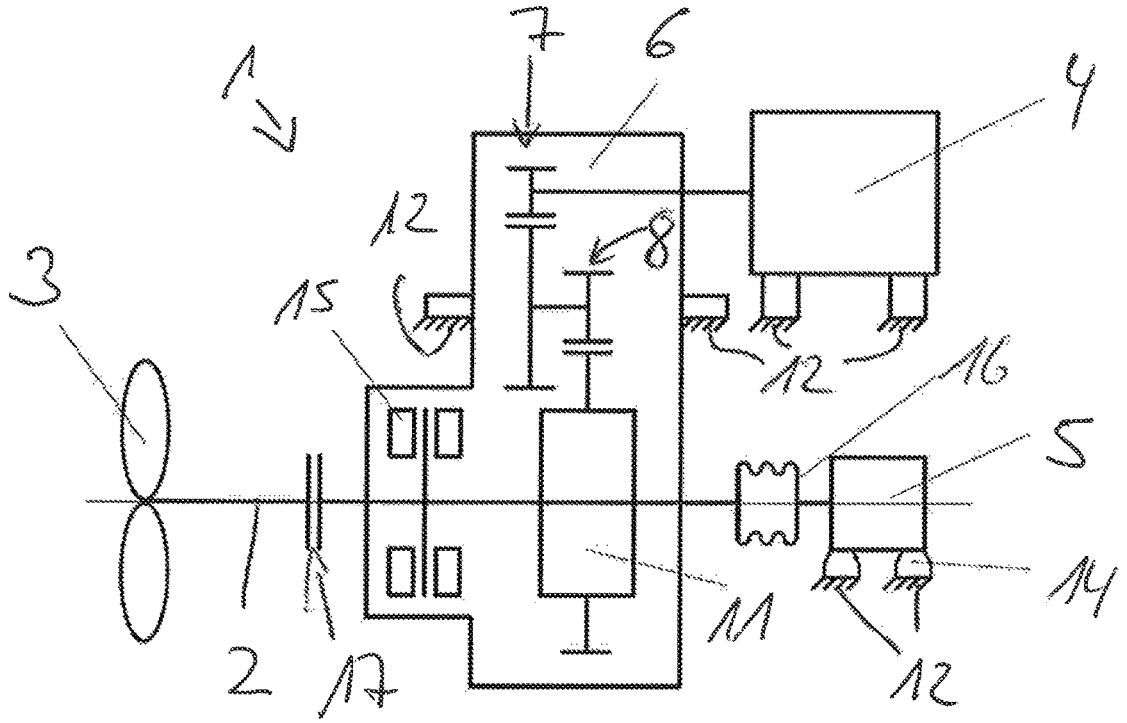
FIG. 4: is a block diagram of a submarine drive system according to one aspect of the invention.
Figure 5:
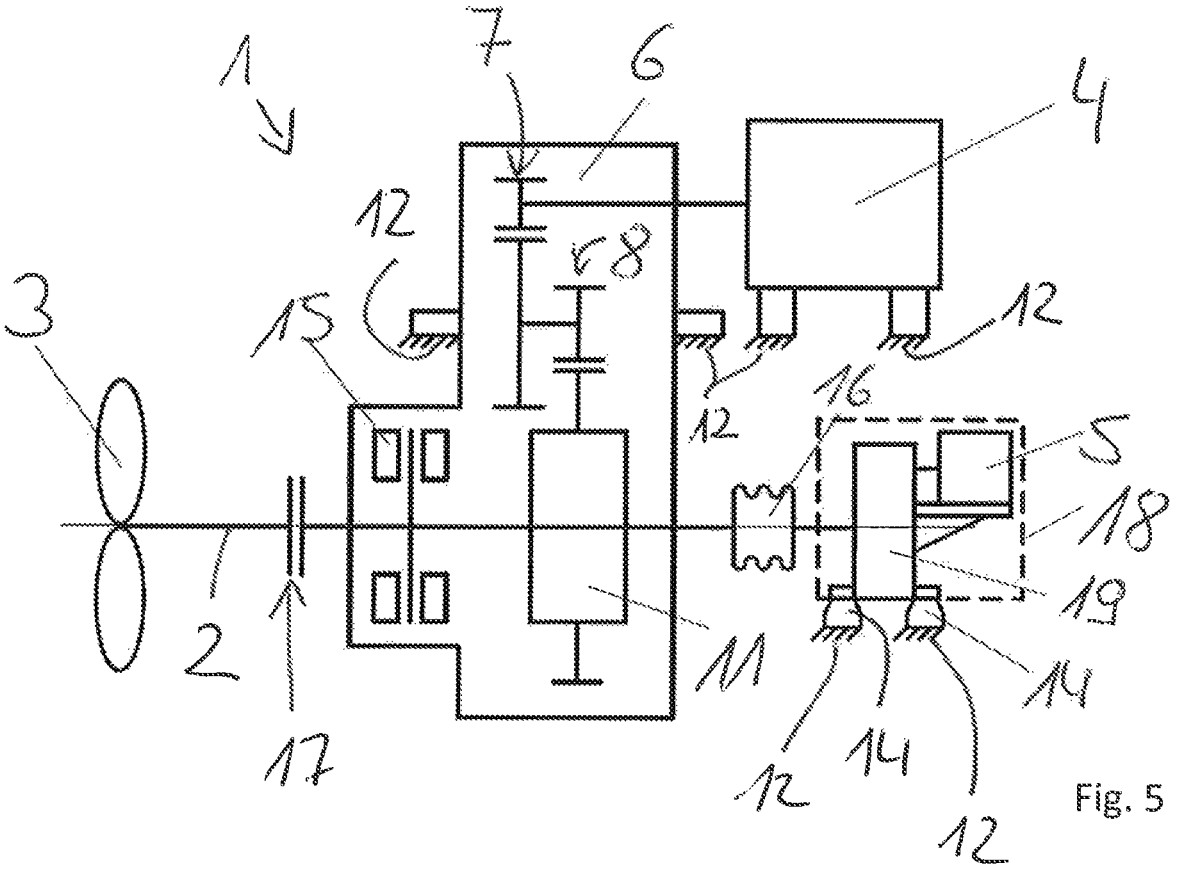
FIG. 5: is a block diagram of a submarine drive system according to one aspect of the invention.

Submarine drive systems 1 according to a second version of the invention are shown by FIGS. 4 and 5, wherein the exemplary embodiments of FIGS. 4 and 5 differ from the exemplary embodiments of FIGS. 1 to 3 primarily in that in the exemplary embodiments of FIGS. 4 and 5 the second electric machine 5 designed for the part-load operation does not act on or is supported by the hull or foundation 12 of the submarine together with the first electric machine 4 and the first transmission 6 designed for the full-load operation, but is rather supported on the foundation 12 of the submarine independently of the first electric machine 4 and the first transmission 6.

Here, FIG. 4 shows an embodiment, in which the second electric machine 5 is directly coupled, i.e. without further step-up stage, to the drive shaft 2 on the drive side and as such is supported via elastic sound-damping elements 14 on the foundation 12 of the submarine.

In the embodiment of FIG. 5, by contrast, the second electric machine 5 designed for the part-load operation is not directly but indirectly coupled via a separate, second step-up transmission 19 to the drive shaft 2 and supported via this second transmission 19 and elastic vibration dampers 14 arranged between the second transmission 19 and the foundation 12 of the submarine.

From FIGS. 4 and 5 it is evident that in these exemplary embodiments the first electric machine 4 designed for the full-load operation and the first transmission 6 serving as step-up transmission for the first electric machine 4 are individually supported on the foundation 12, however without the necessity of elastic vibration dampers 14, since during the full-load operation when using the first electric machine 4, a low-noise operation of the submarine, such as is desirable during the part-load operation in particular during stealth operation is desirable, is of subordinate importance.

A further distinction of the exemplary embodiments of FIGS. 4 and 5 from the exemplary embodiments of FIGS. 1 to 3 is that the elastic compensation coupling 16, is not connected between the output of the first transmission 6 and the axial bearing or thrust bearing 15, but rather between the axial bearing or thrust bearing 15 of the drive shaft 2 and the second electric machine 5 or the second transmission 19 designed for the part-load operation.

As already explained above, a low-noise operation of the submarine drive system 1 is only important during the part-load operation, in particular during stealth-operation, so that in the exemplary embodiments of FIGS. 4 and 5 the elastic compensation coupling 16 is then exclusively important for the second electric machine 5 that is supported on the foundation 12 of the submarine independently of the first electric machine 4 and the first transmission 6.

In the exemplary embodiment of FIG. 5, a sound-insulation covering 18 is additionally arranged about the unit of second electric machine 5 and second transmission 19, in order to ensure an even quieter operation of the submarine drive system.

In the exemplary embodiments of FIGS. 4 and 5, the axial bearing or thrust bearing 15 is integrated in the first transmission, which serves as step-up transmission for the first electric machine 4, designed for the full-load operation. By way of this, further installation space advantages can then be realised.

During the full-load operation, the required drive power is provided by the first electric machine 4. For saving size, weight, and costs, the rotational speed of the first electric machine 4 is higher than the required propeller rotational speed, which is why the first transmission 6 is employed with one or more step-up stages. The first electric machine 4 can be switched on and off via the optional clutch or synchronous clutch 11. Torque is directed to the drive propeller 3 in particular via the elastic compensation coupling 16, a shearing force acting on the drive shaft during the operation is transmitted to the hull or the foundation 12 via the axial bearing 15.

During the part-load operation, the required drive power is provided by the second electric machine 5. During stealth and submerged operation, submarines generally require only a minor part of the power.

The second electric machine 5 that is specifically designed for the part-load operation is typically fed from batteries. With regard to the range, the efficiency is of particular importance for the part-load operation. During the part-load operation during stealth and submerged operation, the smaller electric machine 5 is within the range of its rated power and thus has an optimised efficiency, which brings about a greater range.

In the exemplary embodiment of FIGS. 1, 2, and 3, the second electric machine 5 is advantageously attached to the first transmission 6 and in FIG. 1 directly connected to the drive shaft 2. The drive is optionally effected by the first electric machine 4 or the second electric machine 5, depending on power requirement. During the operation with the second electric machine 5, the first electric machine 4 can be decoupled via the clutch 11, which is particularly advantageous with regard to the efficiency.

FIGS. 4 and 5 show exemplary embodiments in which the second electric machine 5 is supported on the foundation 12 independently of the first electric machine 4. Since the first electric machine 4 is only employed in less noise-sensitive operating states, the elastic mounting on the first electric machine 4 can then be dispensed with. In order to be particularly low in noise during slow and submerged operation, the second electric machine 5 is advantageously elastically supported on the foundation 12. The elastic coupling 16 is only necessary between second electric machine 5 and the propeller shaft 2, the same can thus be advantageously designed significantly smaller. Preferentially, the axial bearing or thrust bearing 16 is integrated in the housing of the first transmission 6.

The first transmission 6 can advantageously be a tunnel transmission.

In the exemplary embodiment of FIG. 5, a fast-rotating embodiment is used for the second electric machine 5, in order to be able to save weight, installation space and costs also in the region of the second electric machine 5. For adjusting the rotational speed of the second electric machine 5 to the desired rotational speed of the drive shaft 2, the second transmission 19 is utilised in FIG. 5. In order to minimise noises, the use of an oil pump can be advantageously omitted in the case of the second transmission 19 and an immersion lubrication without a pump realised. The second electric machine 5 and the second transmission 12 are advantageously rigidly aligned relative to one another and jointly mounted elastically on the foundation 12.

Each of the shown exemplary embodiments is advantageously provided with a control, by way of which the automated establishment of the respective desired operating configuration and the monitoring of operation-relevant parameters are made possible.

Accordingly, the control can automatically activate clutches and electric machines in order to automatically utilise the first electric machine 4 during the full-load operation and automatically utilise the second electric machine 5 as drive source during the part-load operation. By way of the control, operating parameters can also be monitored in order to automatically establish the desired operating configuration independently from this and provide the drive power either during the full-load operation via the first electric machine 4 of the main drive or during the part-load operation for a stealth operation and/or submerged operation via the second electric machine 5 of the additional drive.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A submarine drive system comprising:

a drive shaft;

a drive propeller configured to be coupled to the drive shaft;

a main drive comprising at least one first electric machine configured for a full-load operation and configured to be coupled to the drive shaft on a drive side to drive the drive shaft; and an additional drive comprising at least one second electric machine configured for a part-load operation for stealth operation and/or submerged operation of a submarine and is configured to be coupled to the drive shaft on the drive side for driving the drive shaft.

2. The submarine drive system according to claim 1, further comprising:

a first transmission configured to indirectly couple each at least one first electric machine to the drive shaft on the drive side.

3. The submarine drive system according to claim 2, wherein each at least one second electric machine is configured to be coupled to one of:

directly to the drive shaft on the drive side, indirectly to the drive shaft via the first transmission, or indirectly to the drive shaft via a second transmission.

4. The submarine drive system according to claim 2, wherein each at least one second electric machine is supported on the first transmission and together with each at least one first electric machine and the first transmission are jointly supported on a foundation of the submarine.

5. The submarine drive system according to claim 4, wherein each first electric machine and the first transmission is mounted on a common frame and, via the common frame, jointly supported on the foundation of the submarine.

6. The submarine drive system according to claim 4, wherein each at least one second electric machine supported on the first transmission is configured to be coupled to the drive shaft directly without a step-up stage.

7. The submarine drive system according to claim 4, wherein each at least one second electric machine supported on the first transmission is configured to be coupled to the drive shaft on the drive side via a step-up stage of the first transmission.

8. The submarine drive system according to claim 4, wherein a compensation coupling is connected between an output of the first transmission and a thrust bearing of the drive shaft.

9. The submarine drive system according to claim 3, wherein each at least one second electric machine is supported on a foundation of the submarine either directly or indirectly via the second transmission independently of each at least one first electric machine and independently of the first transmission.

10. The submarine drive system according to claim 9, wherein each at least one second electric machine or the second transmission is connected to the foundation of the submarine via sound-damping elements.

11. The submarine drive system according to claim 9, wherein a compensation coupling is connected between each at least one second electric machine or an output of the second transmission and a thrust bearing of the drive shaft.

12. The submarine drive system according to claim 11, wherein the thrust bearing of the drive shaft is integrated in the first transmission.

13. The submarine drive system according to claim 9, wherein the second transmission comprises an immersion lubrication.

14. The submarine drive system according to claim 1, further comprising:

a control configured to activate clutches and electric machines in an automated manner to automatically utilise as a drive source during the full-load operation each at least one first electric machine and during the part-load operation each at least one second electric machine.

15. A submarine drive system comprising:

a drive shaft;

a drive propeller configured to be coupled to the drive shaft;

a main drive comprising at least one first electric machine configured for a full-load operation and configured to be coupled to the drive shaft on a drive side to drive the drive shaft an additional drive comprising at least one second electric machine configured for a part-load operation for stealth operation and/or submerged operation of a submarine and is configured to be coupled to the drive shaft on the drive side for driving the drive shaft; and a first transmission configured to indirectly couple each at least one first electric machine to the drive shaft on the drive side, wherein each at least one second electric machine is supported on the first transmission and together with each at least one first electric machine and the first transmission are jointly supported on a foundation of the submarine, wherein each first electric machine and the first transmission is mounted on a common frame and, via the common frame, jointly supported on the foundation of the submarine, and sound-damping elements via which the common frame is connected to the foundation of the submarine.

* * * * *